US006882276B2

(12) United States Patent
Zukowski et al.

(10) Patent No.: US 6,882,276 B2
(45) Date of Patent: Apr. 19, 2005

(54) METHOD FOR DYNAMICALLY ADDRESSING PHYSICAL MAIL

(75) Inventors: Deborra J. Zukowski, Newtown, CT (US); Brian M. Romansky, Monroe, CT (US); Easton F. Bell, Norwalk, CT (US); Megha Sharma, Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 68 days.

(21) Appl. No.: 10/322,251

(22) Filed: Dec. 17, 2002

(65) Prior Publication Data

US 2004/0113789 A1 Jun. 17, 2004

(51) Int. Cl.[7] ..... G08B 13/14

(52) U.S. Cl. ..... 340/568.8; 340/825.49; 340/825.36

(58) Field of Search ..... 340/568.8, 825.49, 340/825.36; 209/900

(56) References Cited

U.S. PATENT DOCUMENTS

| | | | | | |
|---|---|---|---|---|---|
| 4,598,275 | A | * | 7/1986 | Ross et al. | 340/573.4 |
| 4,688,026 | A | | 8/1987 | Scribner et al. | 235/385 |
| 4,752,951 | A | * | 6/1988 | Konneker | 379/201.07 |
| 5,051,741 | A | | 9/1991 | Wesby | 340/825.49 |
| 5,347,733 | A | * | 9/1994 | Whittington | 40/1.5 |
| 5,363,425 | A | * | 11/1994 | Mufti et al. | 379/201.06 |
| 5,402,469 | A | * | 3/1995 | Hopper et al. | 379/220.01 |
| 5,574,470 | A | | 11/1996 | de Vall | 343/895 |
| 5,610,589 | A | * | 3/1997 | Evans et al. | 340/573.1 |
| 5,774,876 | A | | 6/1998 | Woolley et al. | 705/28 |
| 5,886,634 | A | | 3/1999 | Muhme | 340/572.1 |
| 5,977,913 | A | | 11/1999 | Christ | 342/465 |
| 6,156,988 | A | * | 12/2000 | Baker | 209/584 |
| 6,232,877 | B1 | | 5/2001 | Ashwin | 340/572.1 |
| 6,329,908 | B1 | * | 12/2001 | Frecska | 340/384.7 |
| 6,396,413 | B1 | | 5/2002 | Hines et al. | 340/825.49 |
| 6,657,543 | B1 | | 12/2003 | Chung | 340/573.1 |
| 2003/0057270 | A1 | | 3/2003 | Colleen | 235/375 |

* cited by examiner

*Primary Examiner*—Daniel Wu
*Assistant Examiner*—Sihong Huang
(74) *Attorney, Agent, or Firm*—Ronald Reichman; Angelo N. Chaclas

(57) ABSTRACT

A method for automatically changing the address of an occupant when the occupant moves from one internal address to another internal address. The foregoing is accomplished by placing a radio frequency identification tag in occupant's nameplate, wherein the tag contains encoding information that identifies the occupant so that when the occupant changes his/her location, the nameplate may be used to update a data base and determine the occupant's new address.

16 Claims, 7 Drawing Sheets

| 38 READER | 39 MAIL STOP (37) |
|---|---|
| 26 | INDIVIDUAL OFFICES 11 |
| 27 | 30 |
| 28 | 32 |
| 29 | 32 |

| 40 PERSON'S NAME | 41 MAIL STOP (36) |
|---|---|
| A | 30 |
| B | 32 |
| C | 32 |
| D | OFFICE 11A |
| . | |
| . | |
| . | |
| Z | 30 |

METHOD FOR DYNAMICALLY ADDRESSING PHYSICAL MAIL

CROSS REFERENCE TO RELATED APPLICATIONS

Reference is made to commonly assigned co-pending patent application Ser. No. 10/322,150 filed herewith entitled "A Method For Dynamically Obtaining Telephone Numbers" in the names of Ronald Reichman, Deborra J. Zukowski and Brian Romansky.

FIELD OF THE INVENTION

The invention relates generally to the field of mailing systems and, more particularly, to systems for delivering mail.

BACKGROUND OF THE INVENTION

Governments have created post offices for collecting, sorting and distributing the mail. The United States Postal Service (USPS) currently handles large volumes of mail, which is delivered to individual homes, government offices and many other entities. An individual home may have few occupants and a single mailbox in which the USPS places all of the mail for the occupants of the home. A large apartment house may have many apartments having one or more occupants in which the USPS places all of the mail for the occupants of an apartment in the same mailbox. Small business may have a single mailbox in which the USPS deposits all of the small business mail. The USPS may also deliver the mail to the lobby of medium sized establishments. Large establishments have many people who receive large volumes mail. Typically, the USPS delivers the mail addressed to occupants of large establishments to the establishment's mailroom, or personnel from large establishments go to the USPS to retrieve the establishment's mail.

Mailrooms of large establishments currently handle large volumes of mail, which is delivered to individual offices and/or local distribution points. Large establishments often assign individual internal addresses, which are often kept in computer databases, to the occupants of their buildings to make it easier for their mailroom personnel to deliver internal mail. Mailroom personnel may deliver mail directly to individual offices and/or to mail stops that serve a plurality of offices and/or desks.

As occupants move from one office or desk to another, their internal address changes, and the mailroom should redirect the occupant's mail to the occupant's new address. To have the mail redirected, someone would need to change the occupant's internal address in the database. Often, the internal address change does not occur, so mail continues to be delivered to the occupant's old office address or the occupant's old local distribution point. A great amount of time may transpire before the mailroom realizes that the occupant's internal address has changed. Thus, a disadvantage of the prior art is that mailroom personnel must search for the moved occupant's new address, often by phoning the occupant and asking where to deliver the occupant's mail.

SUMMARY OF THE INVENTION

This invention overcomes the disadvantages of the prior art by automatically changing the address of an occupant when the occupant moves from one internal address to another internal address.

The foregoing is accomplished by placing a radio frequency identification tag in an occupant's nameplate, wherein the tag contains encoding information that identifies the occupant so that when the occupant changes their location, the nameplate may be used to update a data base and determine the occupant's new address.

DETAILED DESCRIPTION OF THE PREFERRED EMBODIMENT

Figure 1:
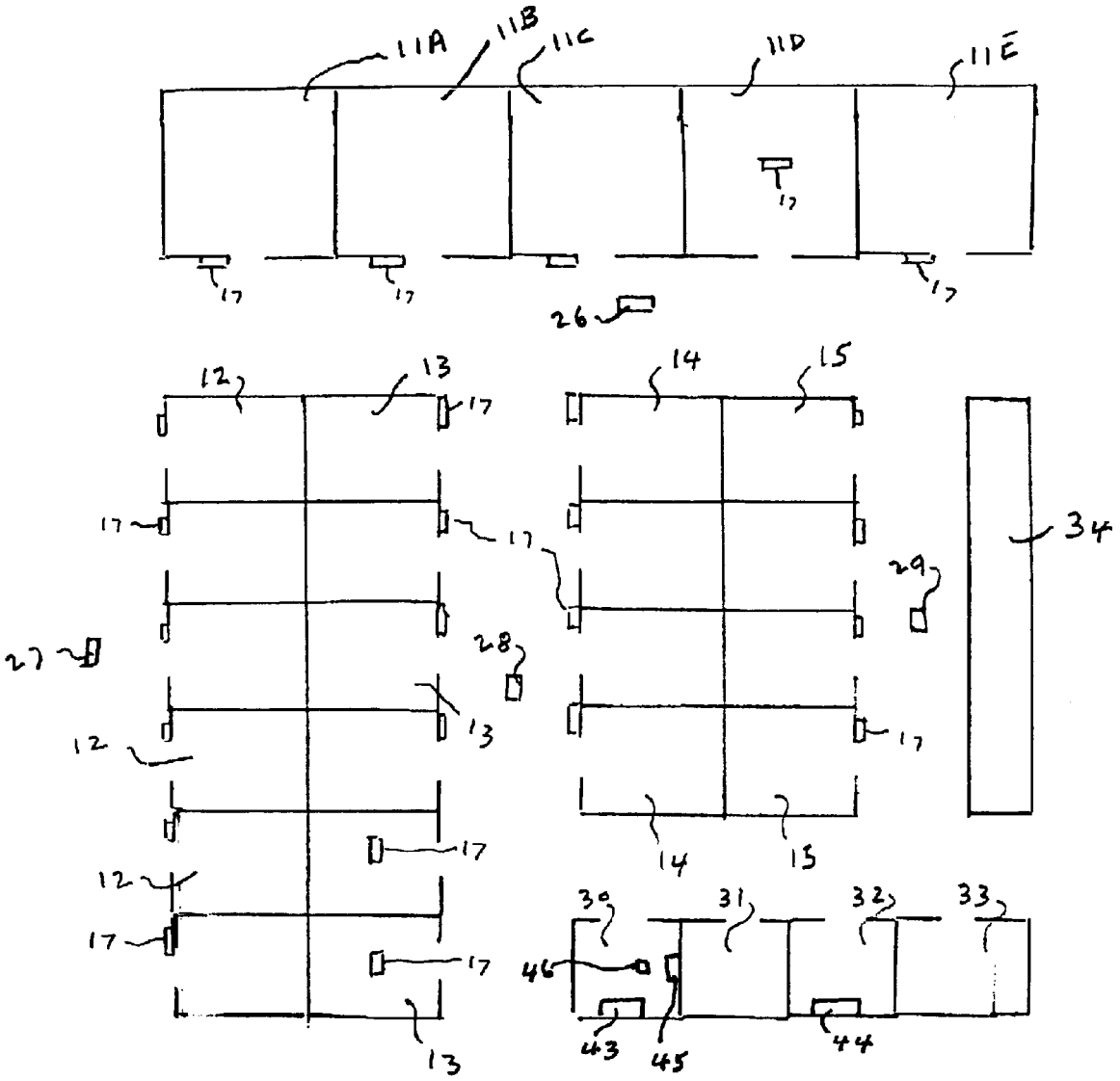
FIG. 1 is a drawing showing some of the offices on floor 5 of a large office building.
Figure 2:
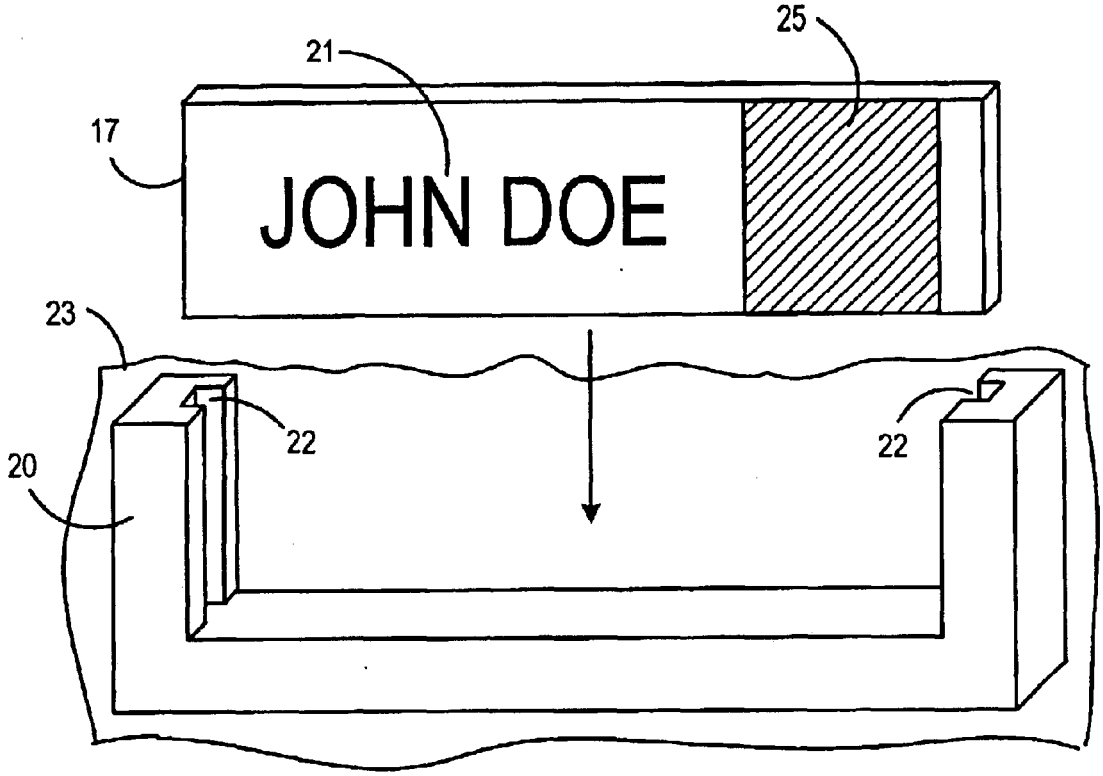
FIG. 2 is a perspective drawing of nameplate 17 showing how nameplate 17 may be placed in a holder.

Referring now to the drawings in detail and more particularly to FIG. 1, the reference characters 11A–11E represent a plurality of large offices on a portion of floor 5 of a large office building. Small offices 12, 13, 14 and 15, mail stops 30 and 32, coffee room 31, photocopy room 33 and filing cabinets 34 are also on floor 5. A hold and forwarding board 45 that is used for the holding and forwarding of mail as well as RFID reader 46 are situated in mail stop 30. Board 45 and reader 46 will be described in the description of FIG. 7. A removable nameplate 17 containing a radio frequency identification (RFID) tag 25 (FIG. 2) that indicates the user of nameplate 17. Nameplate 17 is attached to a wall near the entrance of each office 11A–11E and 12–15 by means of a holder 20 (FIG. 2). Holder 20 may also be placed on any flat surface, i.e., desk inside offices 11–15. The space containing the offices 11A–11E and 12–15 is scanned with scanning devices, e.g., radio frequency identification tag readers 26, 27, 28, 29 and 46, which periodically scan the area to determine if any RFID tag 25 (FIG. 2) is within a given distance from any reader 26, 27, 28, 29 and 46. Reader 26 scans offices 11A–11E, and reader 27 scans offices 12. Reader 28 scans offices 13 and 14, and reader 29 scans offices 15. Reader 46 scans hold and forwarding board 45. Radio frequency identification tag readers 26–29 and 46 may be the Pint Point Cell Controller Network manufactured by RFT Technologies of 3125 N. 126$^{th}$ Street, Brookfield, Wis. 53005.

Mailroom personnel may deliver mail addressed to the occupants of offices 12 by depositing the mail in bins (not shown) located in mail stop 30 and mailroom personnel may deliver mail addressed to the occupants of offices 13, 14 and 15 by depositing the mail in bins (not shown) located in mail stop 32. Mailroom personnel may deliver mail addressed to the occupants of offices 11A–11E by delivering the mail to the occupant's of offices 11A–11E. Display 43, located in mail stop 30, will indicate all of the users of name plates 17 who have their mail delivered to mail stop 30, and display 44 located in mail stop 32 will indicate all of the users of name plates 17 who have their mail delivered to mail stop 32.

FIG. 2 is a perspective drawing of nameplate 17 showing how nameplate 17 may be placed in a holder 20. Nameplate 17 has a region 21 that indicates the user of nameplate 17 and a RFID tag 25 that indicates the user of nameplate 17. RFID tag 25 may be the Pin Point Active RF Tag manufactured by RFT Technologies of 3125 N. 126$^{th}$ Street, Brookfield, Wis. 53005. Additional information regarding the user of name plate 17 may be entered into RFID tag 25, i.e., the user's employee number, the user's social security number, etc. Thus, the information in RFID tag 25 will uniquely identify the user of nameplate 17. Nameplate 17 may be placed in slot 22 of holder 20 and removed from slot 22 of holder 20. Holder 20 is attached to the wall of the entrances of the offices described in FIG. 1 or placed on any flat surface, i.e., desk inside the offices described in FIG. 1. Holder 20 is attached to wall 23 by any known means, i.e., screws, nails, glue, etc.

Figures 3A, 3B, 3C:
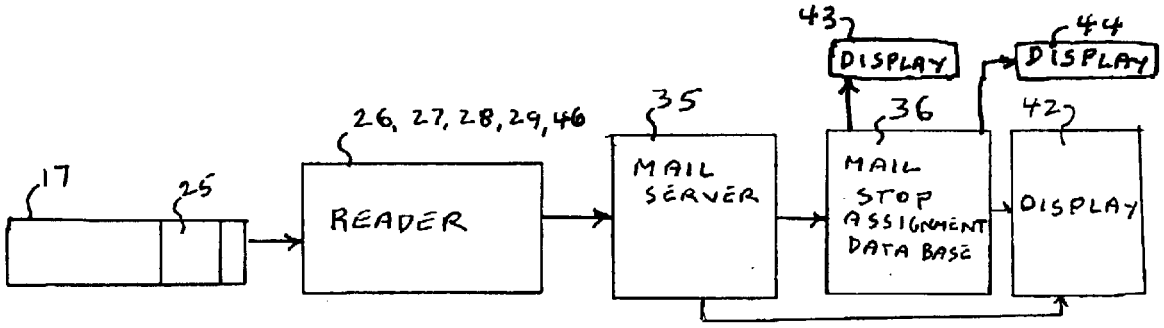
FIG. 3A is a drawing showing the transmission of information from RFID tag 25 to mail stop assignment data base 36.
FIG. 3B is a drawing showing the reader table 37 of mail server 35 of FIG. 3A.
FIG. 3C is a drawing of mail assignment database 36.

FIG. 3A is a drawing showing the transmission of information from RFID tag 25 to mail stop assignment data base 36. Periodically, radio frequency identification tag readers 26–29 and 46, poll their areas of search to determine all nameplates 17 in their areas of search. The list of nameplates, along with each tag readers 26–29 and 46 identity and the users of nameplates 17 indicated in tags 25, are transmitted to mail server 35. Mail server 35 includes a nameplate tracking system reader table 37 (FIG. 3B) that associates each reader with a mail stop or a individual office delivery point. Server 35 is coupled to mail stop assignment data base 36. Database 36 will be described in the description of FIG. 3C. Mail server 35 and database 36 are coupled to display 42. Display 42, located in or near mail sorting area, displays information contained in mail server 35 and database 36. Display 43, located in mail stop 30, is coupled to database 36 and display 44, located in mail stop 32, is coupled to database 36. Display 43 indicates all of the users of nameplates 17 who have their mail delivered to mail stop 30, and display 44 indicates all of the users of nameplates 17 who have their mail delivered to mail stop 32.

It will be obvious to one skilled in the art that radio frequency identification tag readers and radio frequency identification tags may be located on all or some of the floors of a building and/or located in different buildings and then coupled to mail server 35.

FIG. 3B is a drawing showing the nameplate tracking system reader table 37 of mail server 35 of FIG. 3A. Reader table 37 is a static, pre-configured table. Column 38 of table 37 indicates the RFID tag reader identity that read tags 25, and column 39 indicates the mail stop that is associated with the particular RFID tag reader. Thus, mail that is going to be addressed to the user of name plate 17, identified in tags 25 and read by reader 27, will be delivered to mail stop 32.

FIG. 3C is a drawing of mail assignment database 36. Database 36 is a dynamic database that associates the user of nameplate 17 identified in the RFID tag 25 with the mail stop or office to which their mail will be delivered. Column 40, of database 36, indicates the person's name, and column 41 indicates their associated mail stop. Thus, person A will receive their mail at mail stop 30. When a person changes offices they will usually be assigned a different mail stop.

Figure 4:
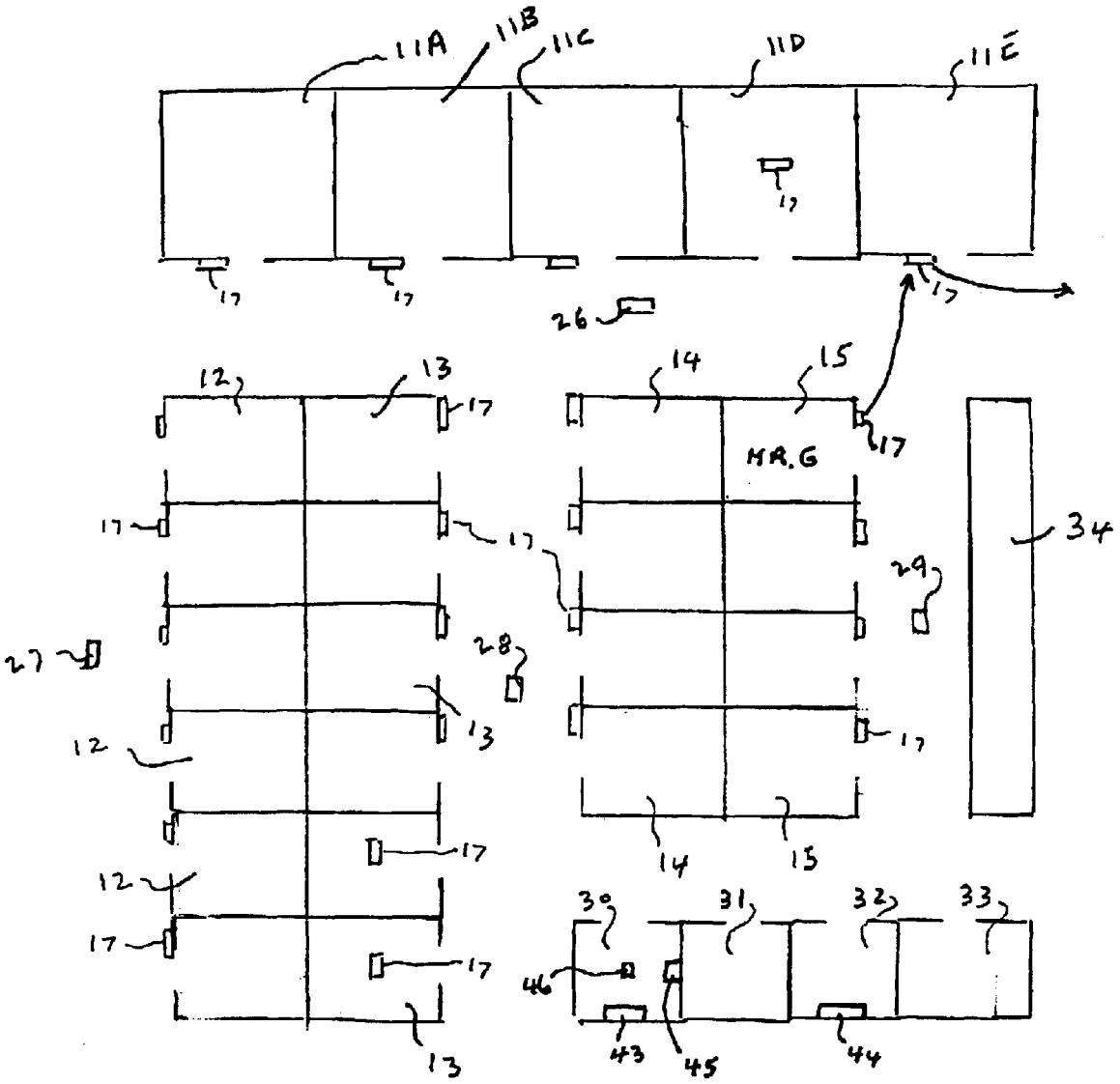
FIG. 4 is a drawing showing an occupant of an office 15 of FIG. 1 moving to office 11E of FIG. 1.

FIG. 4 is a drawing showing an occupant of an office 15 of FIG. 1 moving to office 11E of FIG. 1. When Mr. G, the occupant of one of the offices 15, moves to office 11E, Mr. G removes his name plate 17 from a holder 20 (FIG. 2) attached to the wall near the entrance of his old office 15 and places name plate 17 in a holder 20 (FIG. 2) attached to the wall near the entrance of his new office 11E. The prior occupant of office 11E, Ms. H, removed her name plate 17 and placed it in a holder 20 (FIG. 2) attached to the wall near the entrance of her new office (not shown) which is on the twentieth floor of the same office building. Mr. G may notify mailroom personnel to update assignment database 36 to indicate that he has moved to office 11E, and that his mail should be delivered directly to his office.

Figure 5:
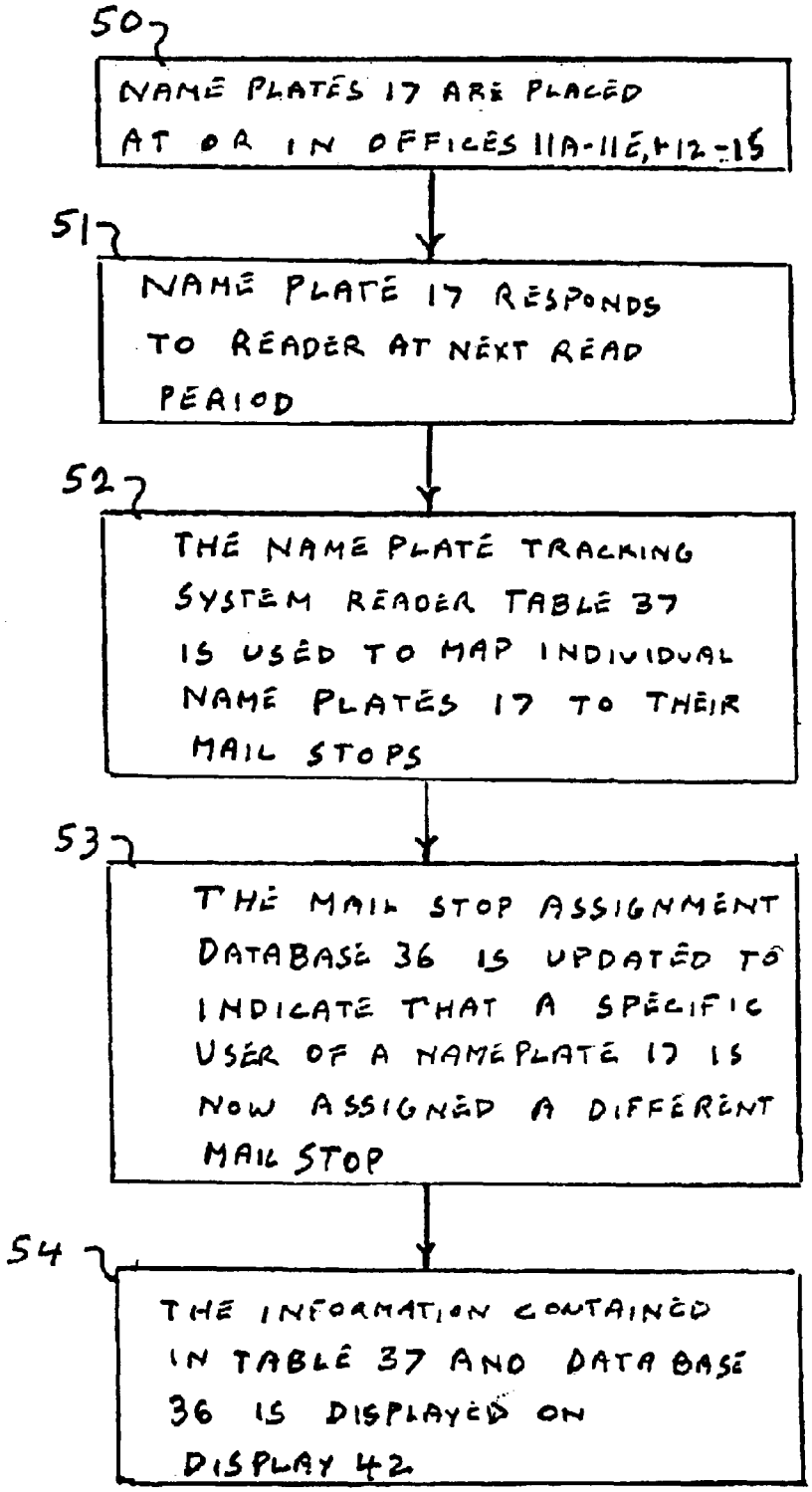
FIG. 5 is a drawing of the process flow for the transmission of information from RFID tag 25 to mail stop assignment database 36.

FIG. 5 is a drawing of the process flow for the transmission of information from RFID tag 25 to mail stop assignment database 36. The process begins in step 50, where nameplates 17 are placed at the entrances of or in offices 11A–11E, and 12–15. Next in step 51, individual nameplates 17 respond to their assigned readers at the next reader period. Then in step 52, the nameplate tracking reader table 37 is used to map individual nameplates 17 to their mail stops. Now in step 53, the mail stop assignment database 36 is updated to indicate that a specific user of a nameplate 17 is now assigned a different mail stop. Then in step 54, the information contained in nameplate tracking reader table 37 and database 36 is displayed in display 42. An email is sent to the person asking if he/she wants to order new business cards. If so, a business card provider may be notified to print new business cards indicating the new address for the user of nameplate 17.

If Mr. G does not notify mailroom personnel to update assignment database 36 to indicate that he has moved to office 11E, reader 26 will poll its area of search during its next search period and determine that a new nameplate 17 is at office 11E. Mail stop assignment database 36 (FIG. 3A) will be updated in the manner described in FIG. 5. If Ms. H does not notify mailroom personnel to update assignment database 36 to indicate that she has moved to a new office, a reader (not shown) on the twentieth floor similar to reader 26 will poll its area of search during its next search period and determine that a new nameplate 17 is at Ms. H's new office. Mail stop assignment database 36 (FIG. 3A) will be updated in the manner described in FIG. 5.

Figure 6:
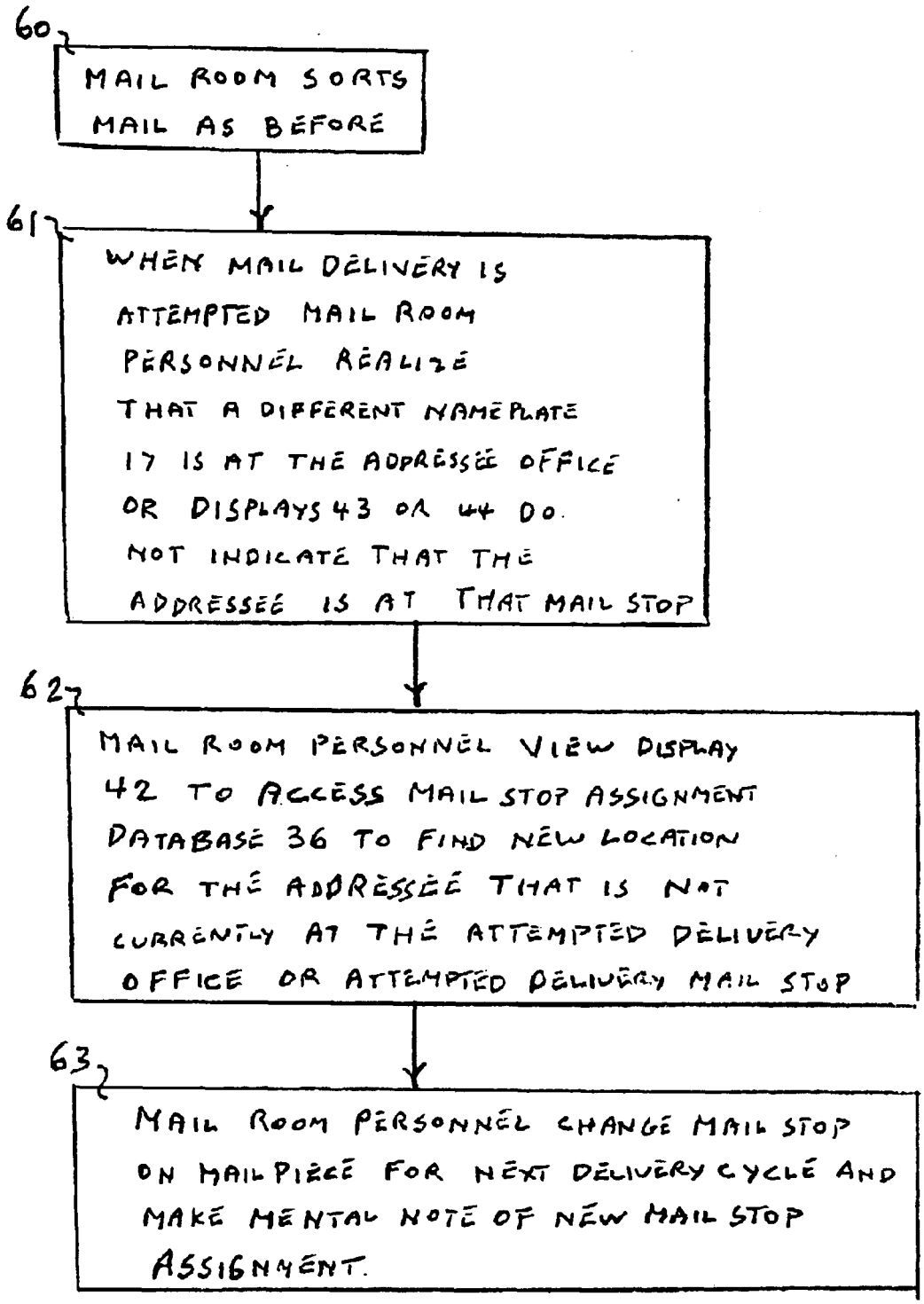
FIG. 6 is a drawing of the process flow when the occupant of an office does not inform mailroom personnel that they have moved to a different office.

FIG. 6 is a drawing of the process flow when the occupant of an office does not inform mailroom personnel that they have moved to a different office. The process begins in step 60, where mail room personnel sort and deliver mail as they have done before. Next in step 61, when mail delivery is attempted, mail room personnel realize that a different name plate 17 is at the addressee office, or displays 43 or 44 do not indicate that the addressee is at that mail stop. Now in step 62, mail room personnel view display 42 to access mail stop assignment database 36 to find the new location for the addressee who is not currently at the attempted delivery office or attempted delivery mail stop. Then in step 63, mailroom personnel change the mail stop on the mail pieces for the next delivery cycle and make a mental note of the new mail stop assignment.

Figure 7:
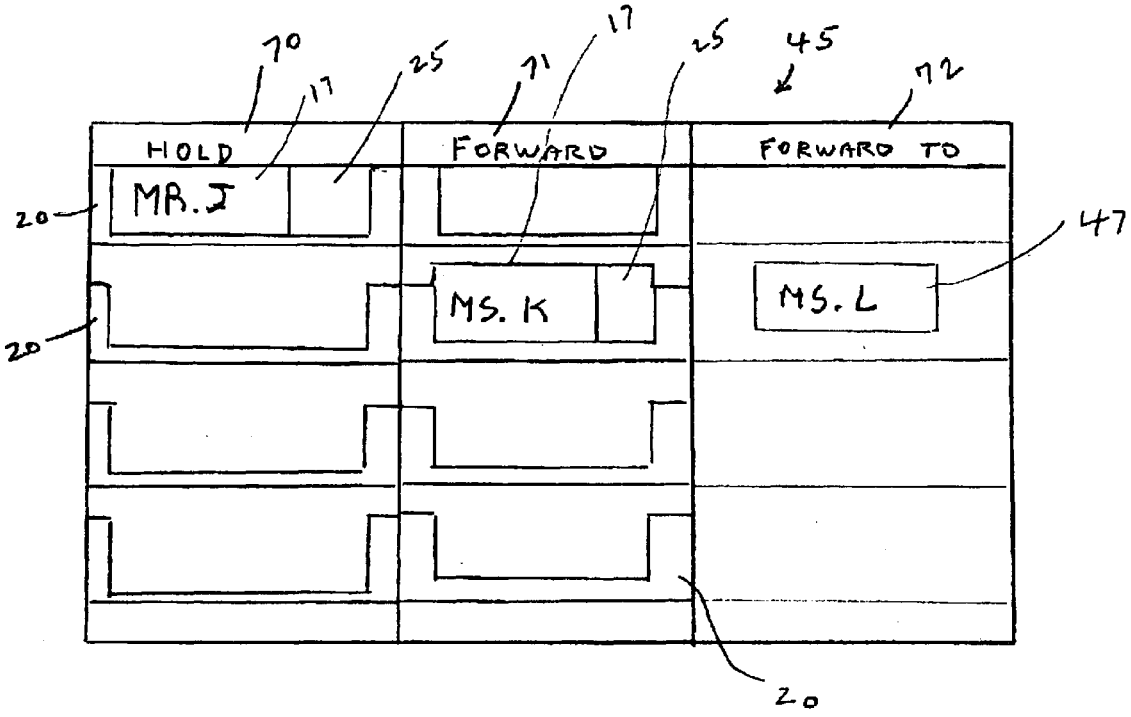
FIG. 7 is a drawing of hold and forwarding board 45 of FIG. 1 in greater detail.

FIG. 7 is a drawing of hold and forwarding board 45 of FIG. 1 in greater detail. Board 45 has a hold column 70, a forward column 71, and a forward to column 72. A plurality of holders 20, are attached to hold column 70 and forward column 71. When the occupant of an office 11A–11E or 12–15 (FIG. 1), i.e., Mr. J, desires his mail held because he is going to be out of the office, he will place his name plate 17 containing RFID tag 25 in a empty holder 20 in hold column 70. When the occupant of an office 11A–11E or 12–15 (FIG. 1), i.e., Ms. K, desires that her mail be forwarded to someone else, she will place her name plate 17 containing RFID tag 25 in an empty holder 20 in forward column 71 and attach a piece of paper 47 indicating that she wants her mail forwarded to Ms. L.

When tag reader 46 periodically scans the area to determine if any RFID tag 25 is within a given distance from any reader 46, reader 46 will report to mail server 35 and mail stop assignment database 36 (FIG. 3A) that Mr. J and Ms. K have placed their name plates 17 in a holder 20 of board 45. The mail delivery information is now up to date. However, mailroom personnel may not be aware of the hold and forwarding instructions until they attempt to deliver the mail. When mailroom personnel arrive at the original mail stop, i.e., mail stop 30, they will not find that Mr. J and Ms. K names are displayed in display 43 44 (FIG. 1) and that their nameplates are not on any other offices 11A–11E or 12–15. At that time, mailroom personnel may place the mail aside, finish the route, and return to the mailroom. They will then access mail stop assignment database 36 to determine that Mr. J's and Ms. K's nameplates 17 are in board 45, which is located at mail stop 30. Then the mailroom personnel will view board 45 and determine that Mr. J wants his mail held and Ms. K wants her mail forwarded to Ms. L.

The above specification describes a new and improved method for changing the address of an occupant when the occupant moves from one internal address to another internal address. It is realized that the above description may indicate to those skilled in the art additional ways in which the principles of this invention may be used without departing from the spirit. Therefore, it is intended that this invention be limited only by the scope of the appended claims.

What is claimed is:

1. A method for delivering physical mall that indicates occupants of establishments after the mail has been delivered to the establishment, said method comprises the steps of:

A. identifying an occupant's name in an establishment in an electronic mechanism contained in an office nameplate that may be moved from a first location to a present location;

B. reading the electronic mechanism to determine the location of the office nameplate; and C. delivering physical mail bused upon the present location of the office nameplate.

2. The method claimed in claim 1, wherein the nameplate is near the entrance of the occupant's office.

3. The method claimed in claim 2, further including the step of:

moving the nameplate near the entrance of the occupant's new office when the location of the occupant's office is changed.

4. The method claimed in claim 3, wherein occupant's office is located on a different floor.

5. The method claimed in claim 3, wherein occupant's office is located in a different building.

6. The method claimed in claim 3, further including the step of:

notifying a printer to print business cards indicating occupant's new office location.

7. The method claimed in claim 3, further including the step of:

notifying a user of the nameplate if the user wants new business cards after an office change.

8. The method claimed in claim 1, further including the step of uniquely identifying occupant's name in the electronic mechanism.

9. The method claimed in claim 8, wherein the occupant's name is uniquely identified, by placing occupant's social security number in the electronic mechanism.

10. The method claimed in claim 8, wherein the occupant's name is uniquely identified, by placing occupant's employee number in the electronic mechanism.

11. The method claimed in claim 1, wherein the nameplate includes occupant's name.

12. The method claimed in claim 1, wherein the electronic medium is a radio frequency identification tag.

13. The method claimed in claim 12, wherein a radio frequency identification tag reader is used to read the radio frequency identification tag.

14. The method claimed in claim 1, further including the step of:

storing occupants name and first location in a database.

15. The method claimed in claim 14, further including the steps of:

displaying occupant's name and first location.

16. The method claimed in claim 14, further including the step of:

updating the data base to indicate occupant's present location.

* * * * *